US006168157B1

(12) United States Patent
Beckman et al.

(10) Patent No.: US 6,168,157 B1
(45) Date of Patent: Jan. 2, 2001

(54) ELECTRONIC BODY-BENDING GAME

(75) Inventors: Ralph A. Beckman, Providence, RI (US); Howard Kamentsky, Cambridge, MA (US); Henry D. Sharpe, III, Saunderstown, RI (US); Kipp L. Bradford, Villanova, PA (US); Stephen A. Schwartz, Providence; John F. Murphy, III, North Scituate, both of RI (US)

(73) Assignee: Hasbro, Inc., Pawtucket, RI (US)

( * ) Notice: Under 35 U.S.C. 154(b), the term of this patent shall be extended for 0 days.

(21) Appl. No.: 09/131,115

(22) Filed: Aug. 7, 1998

(51) Int. Cl.[7] ..... A63F 9/22
(52) U.S. Cl. ..... 273/237
(58) Field of Search ..... 273/138.1, 138.2, 273/139, 237, 236, 459, 460; 340/500, 323 R, 384.1, 384.5; 463/1, 16, 9, 23

(56) References Cited

U.S. PATENT DOCUMENTS

| | | | |
|---|---|---|---|
| D. 384,110 | 9/1997 | Stambolic et al. | 21/1 |
| 491,833 | 2/1893 | Bowen et al. . | |
| 2,315,793 | 4/1943 | Jay | 84/476 |
| 2,879,685 | 3/1959 | Page | 84/470 |
| 3,087,259 | 4/1963 | Orlick et al. | 35/35 |
| 3,101,556 | 8/1963 | Di Ponte | 35/35 |
| 3,382,588 | 5/1968 | Serrell et al. | 35/9 |
| 3,460,838 | 8/1969 | Greenlee, Jr. | 274/1 |
| 3,491,461 | 1/1970 | Echterling | 35/35 |
| 3,768,179 | 10/1973 | Woodford et al. | 35/35 D |
| 4,285,517 | 8/1981 | Morrison | 273/1 GC |
| 4,651,613 | 3/1987 | Harrison | 84/95 C |
| 4,770,416 | 9/1988 | Shimizu et al. | 273/1 GC |
| 4,836,540 | 6/1989 | Bean | 273/1 G |
| 4,936,780 | 6/1990 | Cogliano | 434/311 |
| 4,982,959 | 1/1991 | Rudell et al. | 273/1 GE |
| 5,058,894 | 10/1991 | Levinn et al. | 273/153 R |
| 5,221,225 | 6/1993 | Newbold et al. | 446/297 |
| 5,260,512 | 11/1993 | Chomette et al. | 84/644 |
| 5,288,069 | 2/1994 | Matsumoto | 273/65 EF |
| 5,289,389 | 2/1994 | Keller | 364/551.01 |
| 5,482,277 | 1/1996 | Young | 273/161 |

*Primary Examiner*—Mark A Sager
(74) *Attorney, Agent, or Firm*—Fish & Richardson P.C.

(57) ABSTRACT

A toy includes a housing with pressure sensitive sensors on each face of the housing. The toy instructs players as to which parts of their body they should use in pressing one or more of the sensors on the toy. A number of games can be played with the toy. Players can pass the toy from one player to another using the body parts the toy calls out and try to set records for the number of passes possible without mistake, or can try to set records for the number of passes that can be made within a two minute time period. A third game involves three or four players trying to cover five or six of the sensors in accordance with the toy's instructions. The players maneuver their bodies to maintain pressure on the sensors being held while pressing holding a new sensor called out by the toy. The voice used in the toy also tries to challenge the players to improve on their previous scores.

44 Claims, 10 Drawing Sheets

PASS IT & TURBO PASS

MEGATWIST

ELECTRONIC BODY-BENDING GAME

TECHNICAL FIELD

The invention relates to toys and games.

BACKGROUND

The well-known game of Twister™ includes a spinner and a mat on which are arranged differently colored circles. A player spins the spinner and attempts to put his hand or foot on a circle having the color indicated by the spinner. This continues until a player is unable to reach a circle of the indicated color or a player loses his balance, causing him to remove a hand or a foot from the mat.

SUMMARY

In one general aspect, a toy that implements a body-bending game comparable to the Twister™ game includes a housing, sensors, such as buttons, located on the exterior of the housing, and a processor positioned in the housing and connected to the sensors. The processor is configured to instruct players to press particular sensors and to use particular parts of the body (e.g., hand or foot) when doing so, and is further configured to evaluate whether the players have pressed the particular sensors.

Implementations may include one or more of the following features. For example, the sensors may be implemented as buttons, and the housing may be a multisided housing (e.g., a cube) having cushioned corners and different colored, pressure sensitive, convex, circular buttons on each side. The pressure on each of the buttons is sensed by the processor which provides the players with instructions through a speaker and evaluates the player's compliance with the instructions. The players' game performance is also critiqued by the toy at the conclusion of the game. The buttons are also used by the players to configure the toy (i.e., to select game type, skill level, and numbers of players) by pressing opposing buttons. The players' initial selection of a skill level determines the speed or the difficulty at which the game is started. The skill level can be adjusted by the processor during game play to make the game more challenging.

The sensors are uniquely identified. For example, the sensors may have different colors or different shapes.

Cushioned comers on the toy prevent damage to the toy and injury to the players during game play. The compliance of the cushioned comers also helps players to hold the toy without dropping it, as the cushioned comers tend to center the player's body parts on the sensors, which may be recessed relative to the cushioned comers.

In another general aspect, a toy includes a housing in the shape of a cube. Sensors located on each side of the cube are connected to a processor in the cube. The processor may use a speaker and speech to present the player with options and applicable instructions. A number of games may be played using the toy. The first game involves passing the toy from player to player, within a specified time period, while using the parts of the body designated by the toy to press and hold buttons called out by the toy. The object of the game is to increase the number of passes made between players without a mistake. While the selection of the skill level set by the players determines the initial time period allowed for each transfer of the toy between players, the time period is adjusted during game play to make the game more challenging and interesting.

A second variation of this game employs an overall time limit for the duration of the game. The objective of the game is to increase the number of passes of the toy completed, without a mistake, within the designated time period. As game play continues, the game is made more challenging by the introduction of additional parts of the body to be used in passing the toy from one player to the next.

A third game which can be played with the toy involves three or four players cooperatively covering the buttons as instructed by the toy. The objective of this game is for the players to maneuver their bodies to press and hold the buttons without releasing previously pressed buttons. The difficulty of the game is increased by increasing the number of parts of the body used in pressing and holding the buttons.

Other features and advantages will be apparent from the following description, including the drawings, and from the claims.

DETAILED DESCRIPTION

Figure 1:
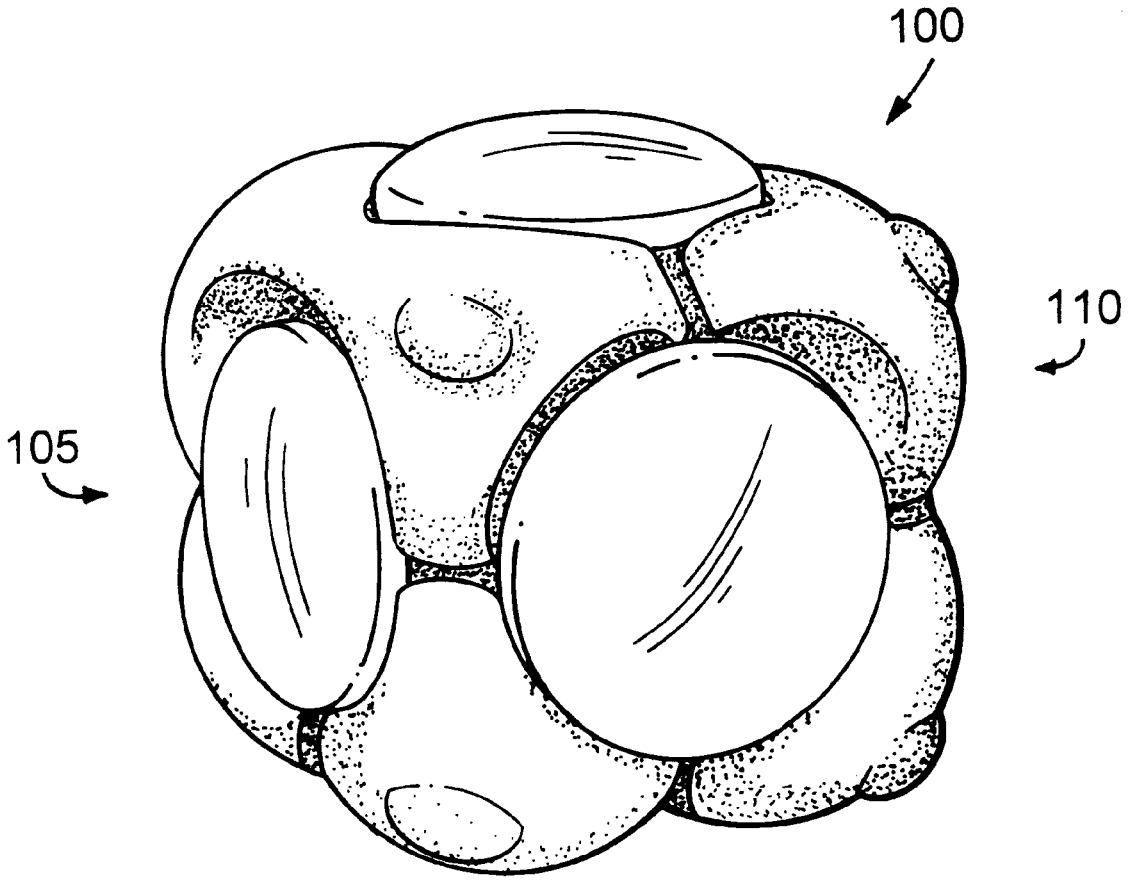
FIG. 1 is a perspective view of an electronic toy.

The toy 100 illustrated in FIG. 1 provides a new version of the well-known Twister™ game. The toy permits two basic variations of the game to be played. The first variation is played by two or more players who pass the toy between them. The toy instructs the players to press colored buttons 105 with particular body parts. Parts of the body that the toy may instruct the players to use include the head, shoulder, elbow, hand, butt, hip, knee, ankle, and foot. The toy may refer to the parts specifically (e.g., left hand) or generally (e.g., foot).

In playing the first variation, the first player holds the toy by pressing the indicated colored buttons using the indicated body parts. Without releasing these colored buttons, the first player then passes the toy to the next player, who presses a new pair of colored buttons indicated by the toy with body parts identified by the toy. After the second player presses the indicated buttons, the first player releases the toy. In this manner, the toy is passed from player to player until the game is ended.

There are two versions of this variation, referred to as "Pass It" and "Turbo Pass." In "Pass It," play continues until a colored button is pressed or released at an inappropriate time, or until the players do not pass the toy from one player to another within a designated time. The designated time is initially set by selecting a skill level, and is gradually reduced as game play continues. The time limit is communicated audibly by a musical, countdown or tick-tock timer. The rate of the timer increases as the game progresses. For example, in "Pass It", a musical score that sets the tempo and rhythm of the game includes a certain number of bars at its conclusion, during which a move must be completed. This musical score may be implemented using a loop having a playback speed that increases over time.

In "Turbo Pass," play continues until a colored button is pressed or released at an inappropriate time, or a two minute timer runs out. The selected skill level controls the number of parts of the body that the game initially uses. This number increases to increase the difficulty of the game as play continues.

The second variation is played by three or four players and requires the players to cooperatively press buttons indicated by the toy using body parts indicated by the toy. The game continues until a colored button is pressed or released at an inappropriate time. This variation is referred to as "Megatwist." As in "Turbo Pass," the skill level in "Megatwist" determines the number of body parts the game uses initially. This number increases to increase the game's difficulty as game play continues. In each of these games the toy evaluates the players' performance and verbally challenges the players to improve their previous performance.

The toy 100 is in the form of a cube. Each of the eight comers of the cube includes a soft rubber cover 110 that extends above the surface of the cube and acts as a cushion. These covers serve to reduce the risk that an injury could occur to the players, or that the toy could be damaged, during game play. The deformable, convex, rubber covers also help the players to hold the toy without dropping it.

Each of the six sides of the cube includes a centrally-located button 105. The buttons are circular, convex, and pressure sensitive. Each button is a different color. For example, in one implementation, the buttons are colored, respectively, blue, orange, purple, yellow, green and red. In some implementations, a lamp may be positioned beneath each button. In other implementations, the buttons may be replaced by other types of sensors, such as strips of pressure-sensitive materials.

Figure 2:
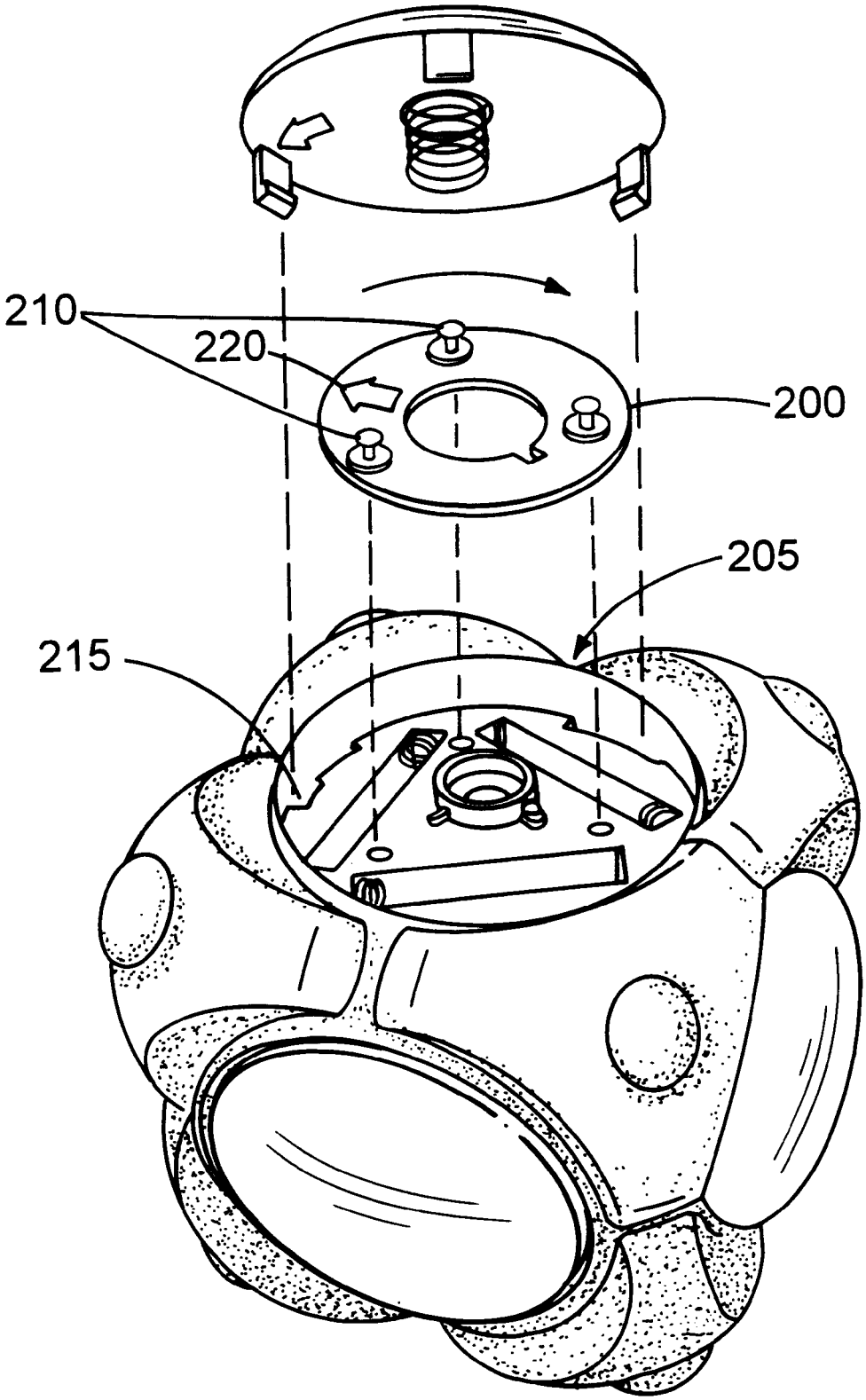
FIGS. 2 and 3 are perspective views illustrating a battery compartment of the toy of FIG. 1.
Figure 3:
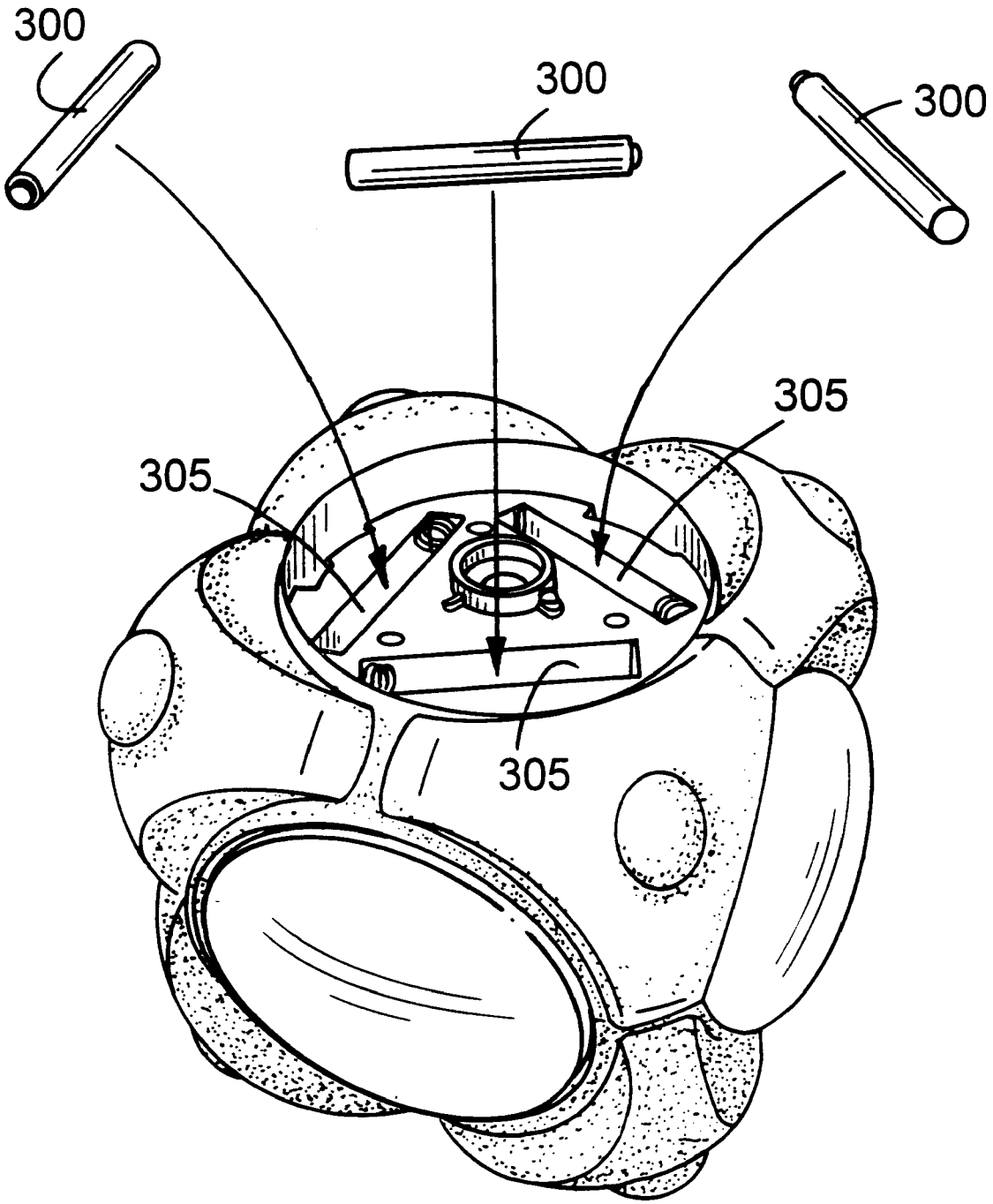

Referring also to FIG. 2, a battery cover 200 and a battery compartment 205 are located under one of the buttons 105. The battery compartment is exposed by pressing and turning the button counterclockwise to release the button. The button then is lifted off to expose the battery cover 200, which is removed by loosening the three screws 210 and lifting the battery cover. As shown in FIG. 3, the toy 100 is powered by three AAA batteries 300 that fit within slots 305. After installing the batteries, the battery cover is replaced and the screws are tightened. The button then is replaced by aligning an arrow 215 inside the bottom with an arrow 220 on the battery cover, pressing the button down, and turning the button clockwise.

Figure 4:
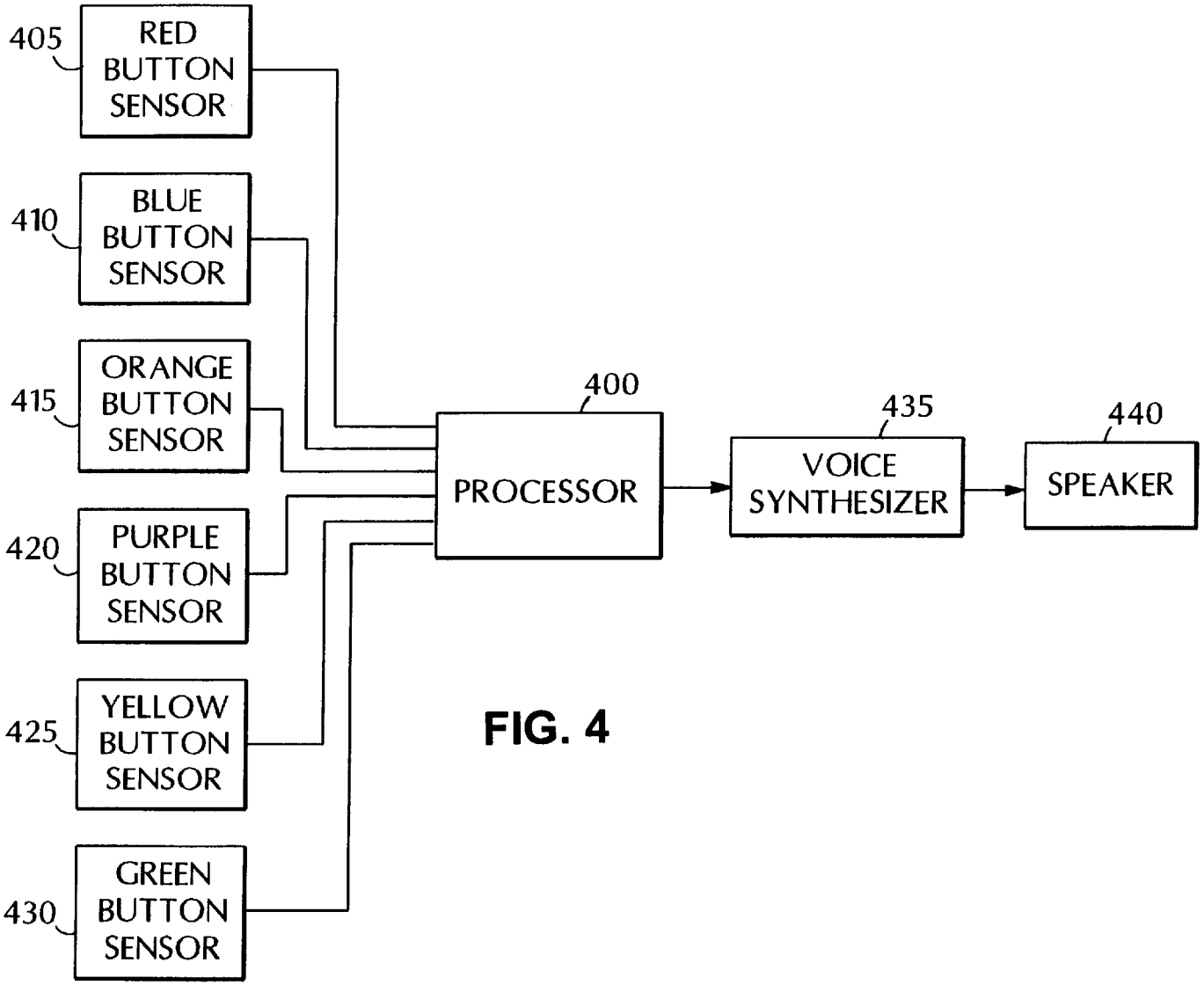
FIG. 4 is a block diagram of the internal components of toy of FIG. 1.

Referring to FIG. 4, a processor 400 is positioned inside the toy 100. The processor receives inputs from the buttons 105 through pressure switches 405–430. The processor provides outputs through a voice synthesizer 435 (or other speech generation device) and a connected speaker 440. In general, the processor monitors the states of the switches, compares the states to expected states, and generates a spoken response through the synthesizer 435 and the speaker 440. In some implementations, the speech generation device may be implemented as a component of the processor.

The processor could also provide outputs through lamps in the cube or in each of the colored switches. The lamps could be used in conjunction with, or instead of, the speech output.

Figure 5:
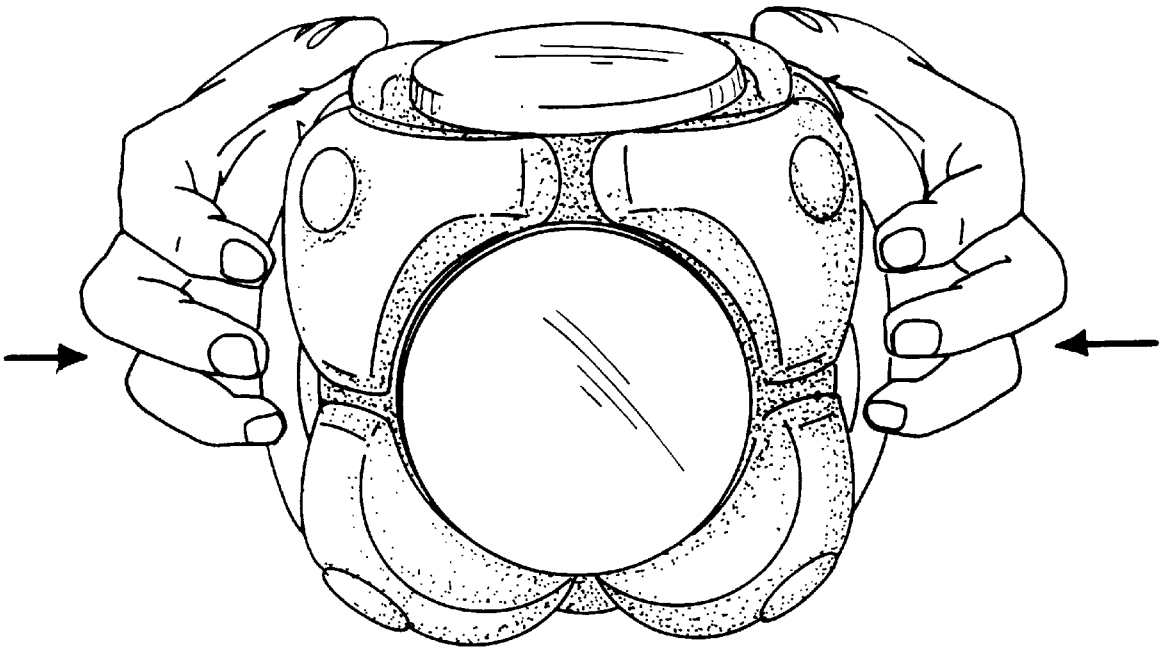
FIG. 5 is a perspective view illustrating activation of the toy of FIG. 1.

Referring to FIG. 5, the toy 100 is activated by simultaneously pressing a predetermined pair of the buttons 110 (for example, opposing yellow and green buttons). The toy does not respond if the wrong buttons are pressed, or if a third button is pressed with the predetermined pair. The game corresponding to each pair of buttons may be identified by labels on the buttons or by prompting from the game.

Figure 6:
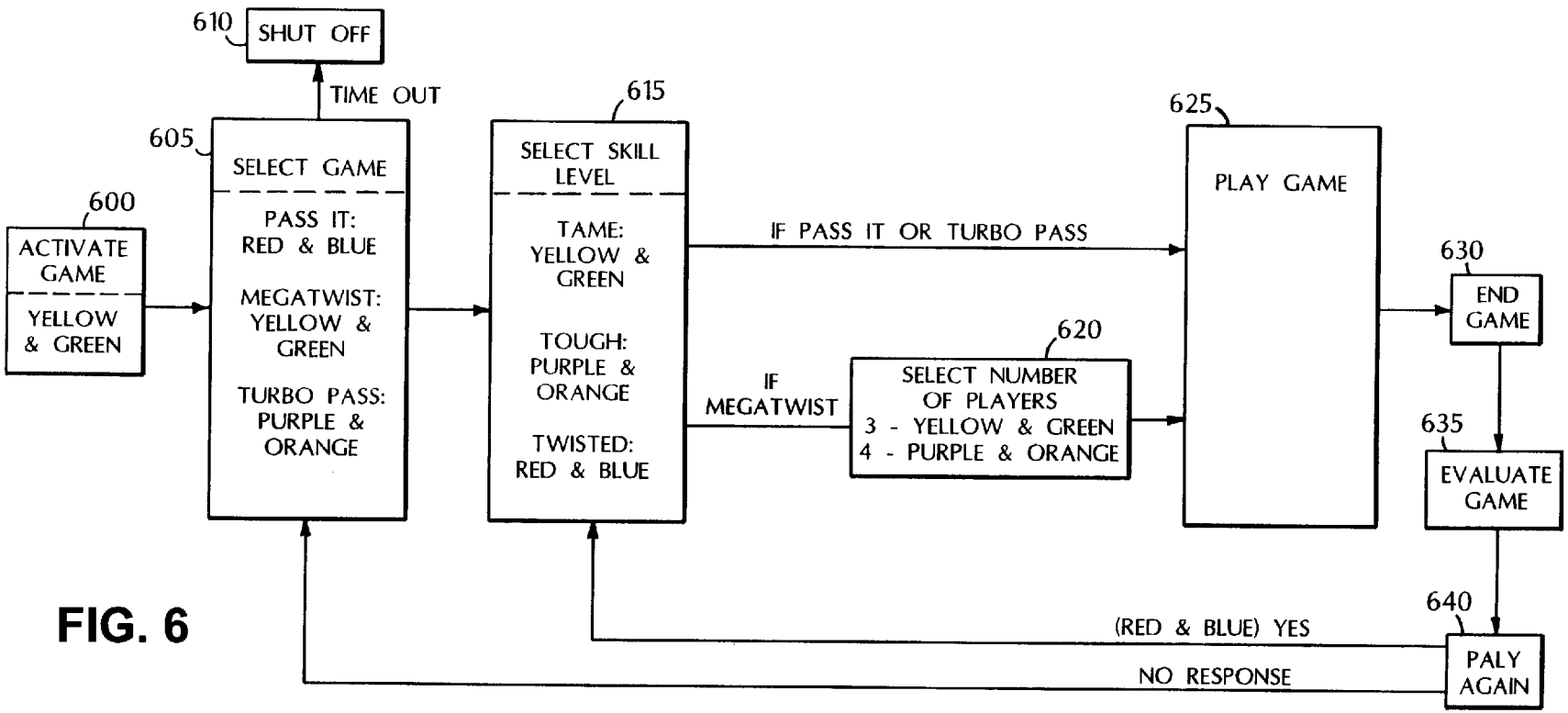
FIG. 6 is a flow chart illustrating operation of the toy of FIG. 1 to play a game.
Figure 7:
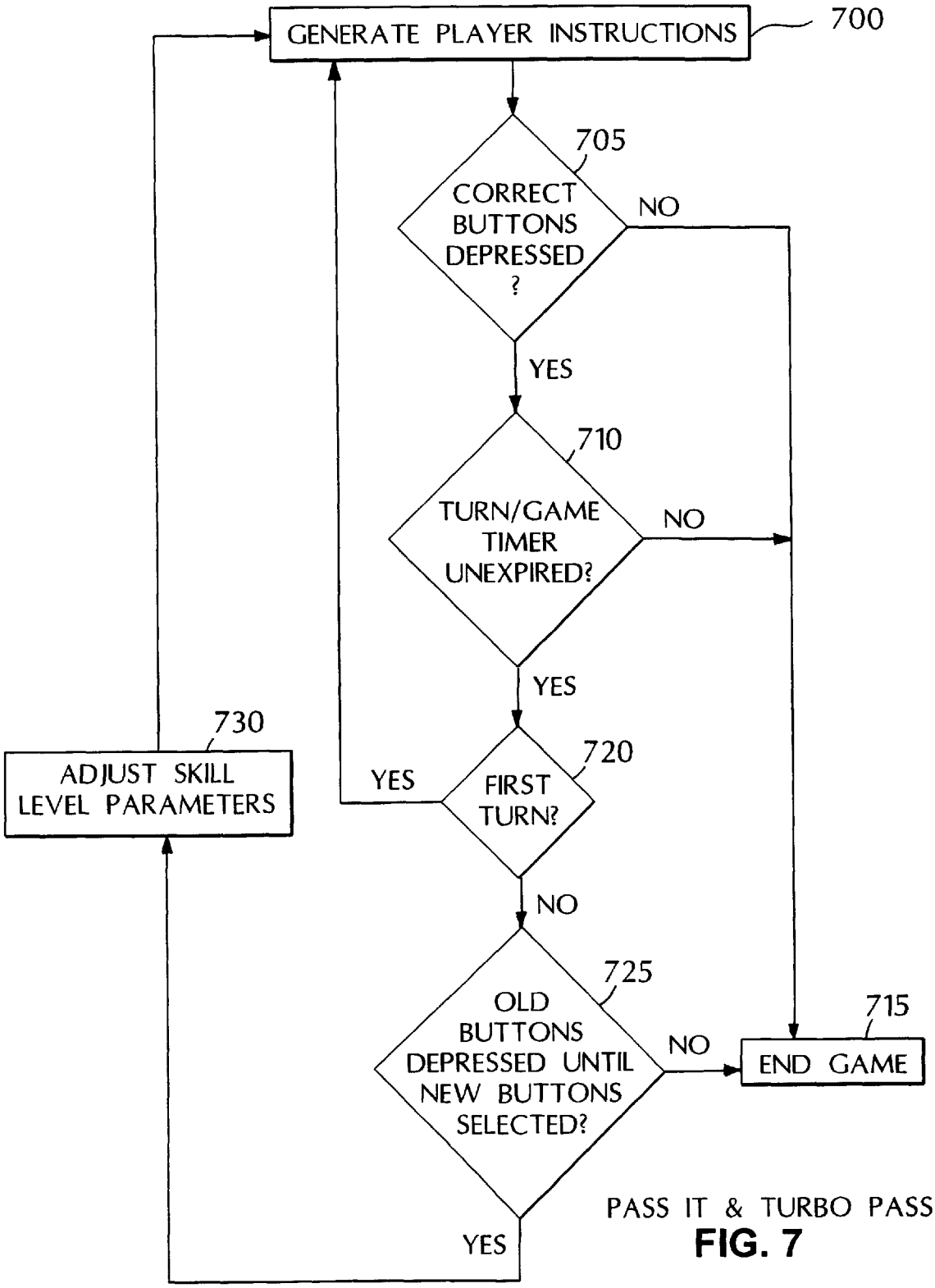
FIG. 7 is a flow chart illustrating game play according to a first set of rules.

FIG. 6 illustrates operation of the toy 100 to select and play a game. First, a player activates the game by simultaneously pressing both the yellow and the green buttons (step 600). The toy then asks the player to select the game to be played by pressing two opposing buttons (step 605). Each opposing pair of buttons corresponds to a different game. As described above, the three games provided are called "Pass It," "MegaTwist" and "Turbo Pass."

If the player does not press two opposing buttons within one minute to select a game, the toy automatically shuts off (step 610).

If a game is selected (step 605), the toy asks the player to select a skill level by pressing an opposing pair of buttons (step 615). The skill level selected is used to determine the amount of time the toy allows for compliance with its instructions in "Pass It" or the number of body parts the toy will use in "Megatwist" and "Turbo Pass." The toy increases the skill level during game play by reducing the length of time permitted for passing the toy or increasing the number of parts of the body used in the game. Once the skill level is accepted, and, if the game selected was "MegaTwist," the toy asks the player whether three or four players will be playing 620). At this point, using the information collected, the toy provides the instructions for game play (step 625).

After the game is concluded (step 630), the toy 100 evaluates the outcome of the game (step 635) and asks the player to play again (step 640). If the red and the blue buttons are pressed in response to this question, the player is asked to select a skill level (step 615). If the player does not respond to the "Play again" question, the player is returned to the "Select Game" question (step 605). If no response is received by the toy after approximately one minute, the game shuts off (step 610).

FIGS. 7 and 8A–8D show play of the "Pass It" and "Turbo Pass" games. As noted above, in the "Pass It" game, play continues until a mistake is made, or too much time is taken to follow instructions. As also noted, in the "Turbo Pass" game, play continues for two minutes or until a mistake is made.

Figure 8D:
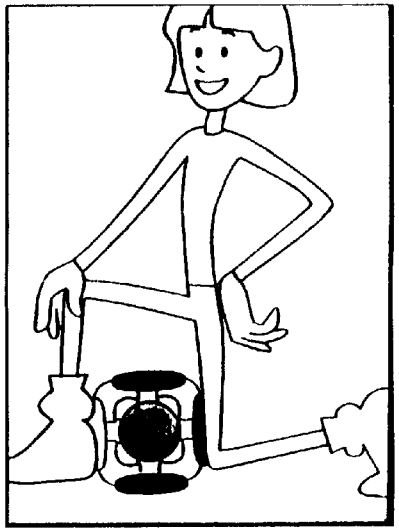
FIGS. 8A–8D illustrate game play according to FIG. 7.
Figure 8C:
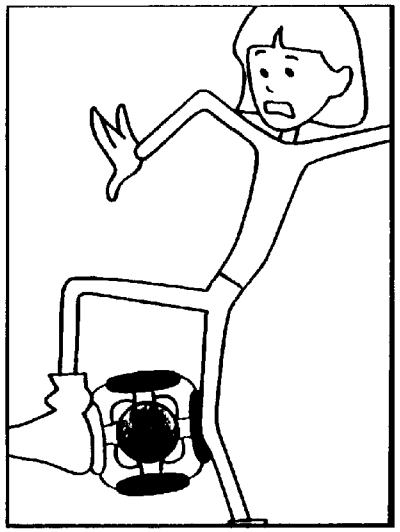
Figure 8B:
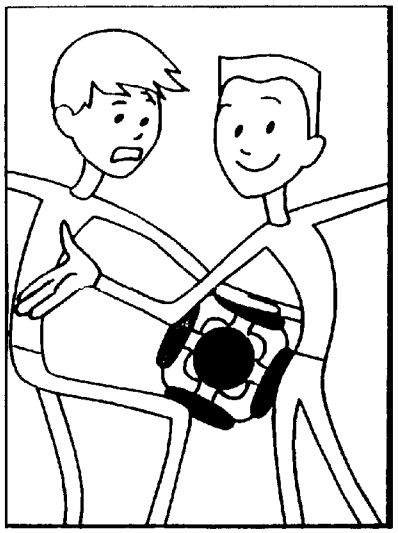
Figure 8A:
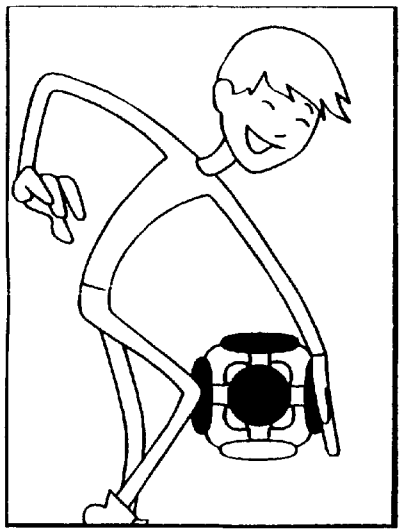
Figure 9:
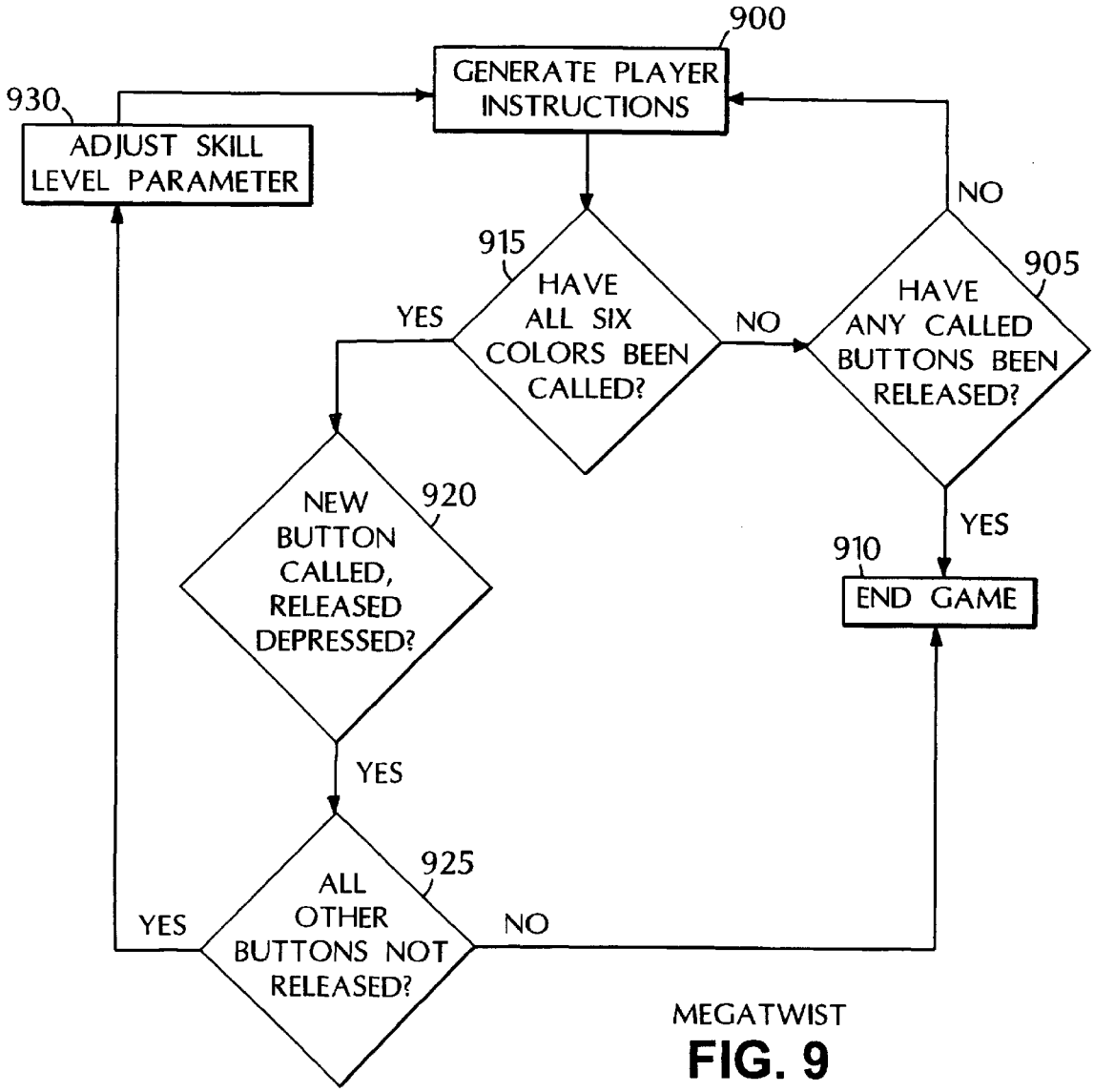
FIG. 9 is a flow chart illustrating game play according to a second set of rules.

Initially, the toy gives the player instructions (step 700). For example, as shown in FIG. 8A, the game says "Hand red, knee blue." Once the instructions are given, the first player responds appropriately. Either hand may be used to press the red button, and either knee may be used to press the blue button. Thus, as shown in FIG. 8A, the player presses the red button with his left hand and the blue button with his right knee. The toy 100 determines whether the correct buttons are being pressed (step 705) and within the appropriate time (step 710). If they are not, the game is over (step 715).

Once the toy 100 determines that the correct buttons are being pressed (step 705), and that this is the first player (step 720), the toy gives the next player instructions (step 700). For example, as shown in FIG. 8B, the game says "Hip purple, elbow orange." The next player then uses his right elbow to press the orange button, and his right hip to press the purple button, as shown in FIG. 8B. If the first player releases either or both of his buttons before the second player has pressed the appropriate buttons (step 725), the game is over. The game is also over if the players take too much time in passing the toy from one player to the other (step 710). Once the second player presses the purple and orange buttons, the game continues and the first player can release the red and blue buttons.

Once the toy 100 determines that the correct buttons are being pressed, and the other buttons have been released, the game continues, with additional instructions (step 700) given to the next player to receive the game. Thus, as shown in FIG. 8C, the game says "Knee green, foot yellow." Once the toy is successfully passed to this player, as shown in FIG. 8C, the players may reposition themselves without ending the game, as long as they keep the corresponding buttons pressed, as shown in FIG. 8D. Each time the toy is successfully passed between players, the toy can adjust the skill level (step 730).

In "Pass It", the game continues until a button is pressed or released at an inappropriate time, or the time limit for passing the toy from one player to another is exceeded. In "Turbo Pass", the game continues until a button is pressed or released at an inappropriate time, or the two minute game limit is exceeded (step 715).

The toy is programmed to eliminate impossible or overly difficult combinations, such as, for example, "head" and "foot". To this end, the toy may employ a table of appropriate combinations from which the toy selects.

FIGS. 9 and 10A–10F show play of the "Megatwist" game. As noted above the "Megatwist" game continues until the instructions are not followed or pressure is released from one of the buttons at an inappropriate time.

Figure 10A:
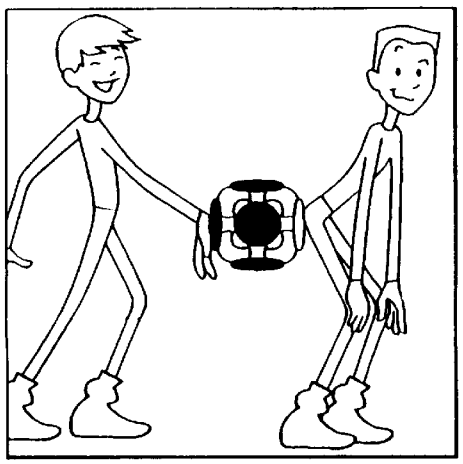
FIGS. 10A–10F illustrate game play according to FIG. 9.

Initially, the toy gives the players instructions (step 900). For example, as shown in FIG. 10A, the game says "Player 1: Hand, green. Player 2: Butt, yellow." Once the instructions are given, the first two players respond appropriately. Thus, as shown in FIG. 10A, the first player uses his right hand to press the green button, and the second player uses his butt to press the yellow button. The toy 100 determines whether the correct buttons are being pressed (step 905). If they are not correct, the game is over (step 910). The players may determine that the game is over if the wrong body parts are used to press the buttons.

Figure 10B:
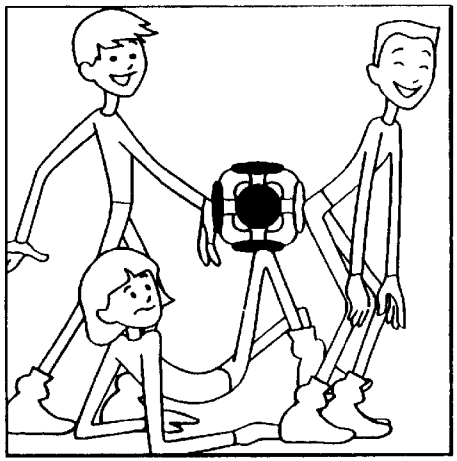

If the correct buttons are being pressed (step 905), the toy gives the next player instructions (step 900). For example, as shown in FIG. 10B, the game says "Player 3, Knee, blue." Once the instructions are given, the third player presses the blue button with her knee as show in FIG. 10B.

The toy determines that the correct buttons are being pressed (step 905) and gives instructions (step 900) to the fourth player. For example, as shown in FIG. 10C, the toy says "Player 4, Head, red." If pressure is released from one of the buttons at an inappropriate time the game is ended (step 905).

Figure 10C:
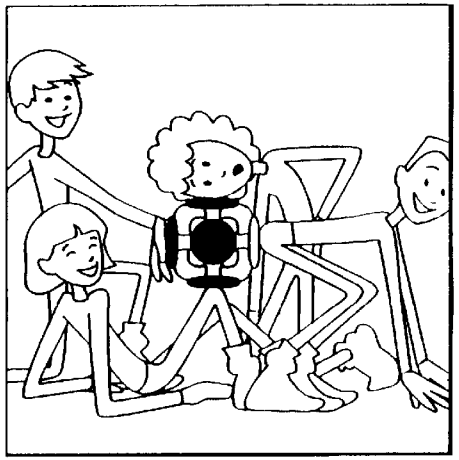
Figure 10D:
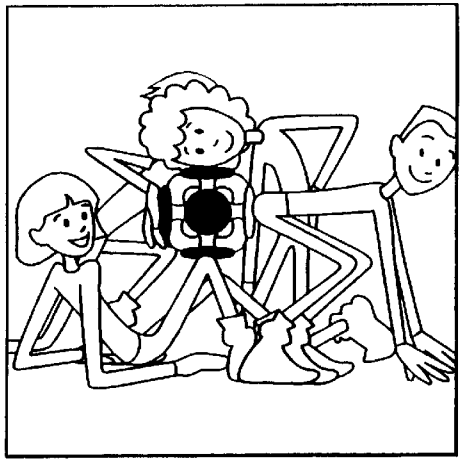

Once the fourth player presses the red button, as shown in FIG. 10C, the toy determines whether the correct buttons are being pressed (step 905). If all of the correct buttons are being pressed, the toy gives further instructions (step 900). For example, as shown in FIG. 10D the toy says "Player 1: Shoulder, orange."

As noted above, the toy also knows the human body's limitations. For example, the toy will never ask the same player to press one button with his head and another button with his butt.

Figure 10E:
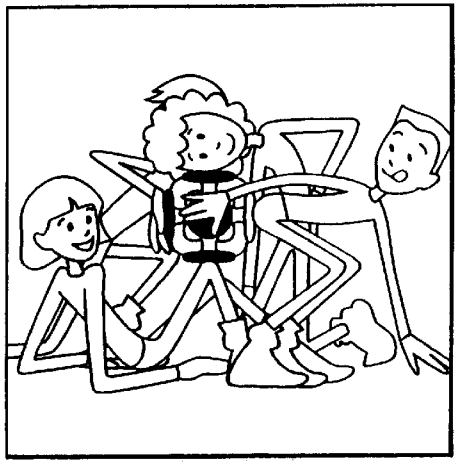

As shown in FIG. 10D, player 1 now has his right hand on the green button, and his shoulder on the orange button. The toy determines that the correct buttons are being pressed (step 905) and gives player 2 additional instructions (step 900). For example, as shown in FIG. 10E, the toy says "Player 2: Hand, purple." While maintaining the pressure on the yellow button with his butt, player two now presses the purple button with his hand. To this point, if the toy sensed the release of any of the buttons (step 905), the game would be over (step 910).

Figure 10F:
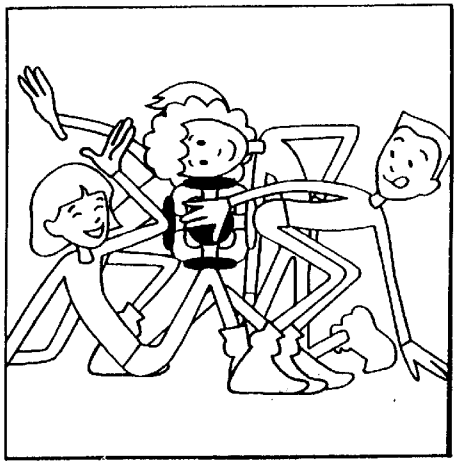

Once all of the colored buttons are covered (step 915), a player may, by following the toy's instructions, release a colored button, without ending the game. For example, the toy says "Player 3: Elbow, green." As shown in FIG. 10F, player 1 may now take his right hand off of the green button, and player three presses the green button with her elbow. Since the toy anticipated the release of the green button by player 1 to allow player 3 to press the button, the toy correctly monitored the pressure changes (step 920) and the game continues until pressure is released from a button at an inappropriate time (step 925). In general, a four player game uses all six buttons, while a three player game may use only five of the six colored buttons. Additionally, each time the players follow the toy's instructions, the skill level may be adjusted to make the game more challenging (step 930).

Other embodiments are within the scope of the following claims. For example, the buttons may be lighted so that, in addition to, or instead of, speech, the processor may use light activation to notify the players of the buttons to press. Similarly, the buttons could be of different shapes rather than of different colors.

What is claimed is:

1. A toy comprising:

a housing;

sensors located on an exterior of the housing; and a processor positioned in the housing and connected to the sensors;

wherein the processor is configured to:

instruct players to press particular sensors, and instruct players as to which parts of the body to use in pressing the sensors.

2. The toy of claim 1, wherein the processor is further configured to evaluate whether the players have pressed the particular sensors.

3. The toy of claim 2, wherein the processor is further configured to evaluate whether a player has ceased pressing a particular sensor.

4. The toy of claim 1, wherein the housing includes multiple sides and a sensor is located on each side of the housing.

5. The toy of claim 4, wherein the housing is in the shape of a cube having six sides and the toy includes six sensors, one of which is located on each of the six sides of the cube.

6. The toy of claim 5, wherein the sensors comprise buttons.

7. The toy of claim 1, further comprising a speaker located in the housing wherein the processor is configured to use sounds to instruct the players.

8. The toy of claim 7, wherein the processor is configured to use speech to instruct the players.

9. The toy of claim 7, wherein the processor is configured to use sounds to communicate status of a time limit to the players.

10. The toy of claim 1, wherein the processor is configured to receive information from the sensors for use in configuring the toy.

11. The toy of claim 10, wherein the sensors are used to receive input from the player to select a game type.

12. The toy of claim 10, wherein the sensors are used to receive input from the player to select a skill level.

13. The toy of claim 10, wherein the sensors are used to receive input from the player to select a number of players.

14. The toy of claim 1, wherein the housing includes cushioned corners.

15. The toy of claim 14, wherein the sensors are recessed relative to the cushioned corners.

16. The toy of claim 1, wherein each sensor has a unique feature that allows the sensor to be identified.

17. The toy of claim 16, wherein each sensor is a different color.

18. The toy of claim 1, wherein the sensors comprise buttons.

19. A toy comprising:

a housing in the shape of a cube;

a sensor on each face of the exterior of the housing;

a processor positioned in the housing, and connected to the sensors; and configured to instruct players to press and hold particular sensors.

20. The toy of claim 19, wherein each sensor has a unique feature that allows the sensor to be identified.

21. The toy of claim 20, wherein each sensor is a different color.

22. The toy of claim 19, wherein the processor is configured to:

instruct players as to which parts of the body to use in pressing the sensors, and evaluate whether the players have pressed or released the particular sensors.

23. The toy of claim 19, further comprising a speaker located in the housing wherein the processor is configured to use sounds to instruct the players.

24. The toy of claim 23, wherein the processor is configured to use speech to instruct the players.

25. The toy of claim 19, further comprising lights associated with each sensor, wherein the processor is configured to use light to instruct the players.

26. The toy of claim 19, wherein the housing includes cushioned corners.

27. A method of playing a game using a toy that includes a housing and sensors on external faces of the housing, the method including:

maintaining a set of rules associated with the game;

instructing the first player to press and hold a first sensor;

instructing the second player to press and hold a second sensor; and evaluating the performance of the players to assess their compliance with the instructions and the rules.

28. The method of claim 27, further comprising determining that the game is over when the players fail to comply with the instructions or rules.

29. The method of claim 28, wherein determining that the game is over comprises determining that the game is over when a sensor is pressed or released at a time that does not comply with the instructions or the rules.

30. The method of claim 28, wherein determining that the game is over comprises determining that the game is over when the first player releases the first sensor before the second player presses and holds the second sensor.

31. The method of claim 28, wherein determining that the game is over comprises determining that the game is over when the transfer of the toy from the first player to the second player does not occur before expiration of a predetermined time limit.

32. The method of claim 31, wherein the predetermined time limit corresponds to a skill level.

33. The method of claim 31, further comprising communicating a status of the time limit using audible cues.

34. The method of claim 31, further comprising adjusting the predetermined time limit during game play.

35. The method of claim 28, wherein determining that the game is over comprises determining that the game is over when a predetermined time period expires.

36. The method of claim 27, further comprising instructing players as to which body parts are to be used in pressing the sensors.

37. The method of claim 36, wherein the number of body parts for use in instructing the players corresponds to a skill level.

38. The method of claim 37, further comprising adjusting the number of body parts for use in instructing the player during game play.

39. The method of claim 36, wherein particular body parts used in instructing the players correspond to a skill level.

40. The method of claim 36, wherein combinations of body parts used in instructing the players correspond to a skill level.

41. The method of claim 27, further comprising instructing a third player to press and hold a sensor.

42. The method of claim 27, wherein the rules require the players to pass the toy from player to player, within a specified time period, while pressing and holding sensors identified in the instructions.

43. The method of claim 27, wherein the rules require the players to pass the toy from player to player, while pressing and holding sensors identified in the instructions, until a designated time period expires.

44. The method of claim 27, wherein the rules require three or more players to maneuver their bodies to press and hold sensors without releasing previously-pressed buttons.

* * * * *